US006945153B2

(12) United States Patent
Knudsen et al.

(10) Patent No.: US 6,945,153 B2
(45) Date of Patent: Sep. 20, 2005

(54) ROPE FOR HEAVY LIFTING APPLICATIONS

(75) Inventors: Robert B. Knudsen, Charlotte, NC (US); Forrest E. Sloan, Chesterfield, VA (US)

(73) Assignees: Celanese Advanced Materials, Inc., Charlotte, NC (US); Puget Sound Rope, Anacortes, WA (US)

( * ) Notice: Subject to any disclaimer, the term of this patent is extended or adjusted under 35 U.S.C. 154(b) by 0 days.

(21) Appl. No.: 10/271,267

(22) Filed: Oct. 15, 2002

(65) Prior Publication Data

US 2004/0069132 A1 Apr. 15, 2004

(51) Int. Cl.[7] ..... D04C 1/12
(52) U.S. Cl. ..... 87/1; 87/7; 87/11
(58) Field of Search ..... 87/1, 5, 7, 8, 13

(56) References Cited

U.S. PATENT DOCUMENTS 5,193,937 A * 3/1993 Miller ..... 405/157
5,632,137 A * 5/1997 Kolmes et al. ..... 57/212
5,901,632 A 5/1999 Ryan
5,931,076 A 8/1999 Ryan

FOREIGN PATENT DOCUMENTS

EP 974698 A1 * 1/2000 ..... D07B/1/02

OTHER PUBLICATIONS

Product Specification Sheet from New England Ropes for STA–SET T–900.
Product Specification Sheet from Samson Rope Technologies for Validator SK.
Product Specification Sheet from Samson Rope Technologies for Lightning Rope.
Product Specification Sheet from Gottifredi Maffioli for DZ.

* cited by examiner

*Primary Examiner*—John J. Calvert
*Assistant Examiner*—Shaun R Hurley
(74) *Attorney, Agent, or Firm*—Robert H. Hammer, III, P.C.

(57) ABSTRACT

A large diameter rope having improved fatigue life on a sheave, pulley, or drum is disclosed. This rope includes a blend of HMPE filaments and liquid crystal polymer filaments selected from the group of lyotropic polymer filaments and thermotropic polymer filaments. The rope may be constructed as a braided rope, a wire-lay rope, or a parallel core rope.

19 Claims, 2 Drawing Sheets

ROPE FOR HEAVY LIFTING APPLICATIONS

FIELD OF THE INVENTION

A rope for heavy lifting or mooring applications, such as marine, oceanographic, offshore oil and gas, seismic, and industrial applications, is disclosed.

BACKGROUND OF THE INVENTION

In heavy lifting or mooring applications, such as marine, oceanographic, offshore oil and gas, seismic, and industrial applications, a standard rope is made from high modulus polyethylene (HMPE) filaments, such as those commercially available under the name of SPECTRA® from Honeywell Performance Fibers of Colonial Heights, Va. and DYNEEMA® from DSM NV of Heerlen, The Netherlands and Toyobo Company Ltd. of Osaka, Japan. These ropes are made into braided ropes or twisted ropes. For example, see U.S. Pat. Nos. 5,901,632 and 5,931,076. Therein is disclosed a braided rope construction in which filaments are twisted to form a twisted yarn, the twisted yarns are braided to form a braided strand, and the braided strands are then braided to form the braided rope.

The type of damage that leads to failure in these ropes is highly dependent on the service conditions, the construction of the rope, but most importantly the type of fibers used to manufacture the rope. When large diameter, high load-capacity ropes are pulled over a drum, pulley, or sheave, as occurs during heavy lifting, e.g. in lowering and raising packages from the seabed, two damage mechanisms are generally observed.

The first damage mechanism is frictional heat generated within the rope. This heat may be caused by the individual elements of the rope abrading one another; as well as, the rope rubbing against the drum, pulley, or sheave. This generated heat can be great enough to cause a catastrophic failure of the rope. This problem is particularly evident when the fiber material loses a substantial amount of strength (or becomes susceptible to creep rupture), when heated above ambient temperature. For example, HMPE fibers exhibit this type of failure; HMPE fibers, however, exhibit the least amount of fiber-to-fiber abrasion.

The second damage mechanism observed during over-sheave cycling of ropes is self-abrasion or fiber-to-fiber abrasion (i.e., rope fibers rubbing against one another). This type of damage is most often observed in ropes made from liquid crystal polymer (LCP) fibers. For example, aramids are known to be a poor material for general rope use because of self-abrasion; aramid fibers, however, are not generally susceptible to creep rupture.

In the studies leading to the instant invention, it was discovered that the primary occurrence of damaging abrasion was at the intersection between the subropes (or strands). Only, a little damage was observed within the subropes. Accordingly, a way to reduce the abrasion between the subropes was investigated.

In the prior art, jacketing the subropes is a known method for reducing abrasion between the subropes. Jacketing refers to the placement of a sleeve material (e.g., woven or braided fabric) over the subrope, so that the jacket is sacrificed to save the subrope. These jackets, however, add to the overall diameter, weight and cost of the rope without any appreciable increase in the rope's strength. The larger size is obviously undesirable because it would require larger drums, pulleys, or sheaves to handle the jacketed rope. In addition, rope jackets make visual inspection of the rope core fibers problematic because the jacket hides the core fibers. Therefore, while this solution was viable, it was considered unsatisfactory.

Accordingly, there is a need for a new rope solution, one without a jacket on the subropes that could be used in heavy lifting or mooring applications and have a reduced risk of failure. This rope solution would have to be resistant to creep rupture (unlike a rope made entirely from HMPE) and also resistant to self-abrasion (unlike a rope made entirely from LCP).

Small diameter rope (i.e., diameters less than or equal to 1.5 inches or 34 mm) made of blends of HMPE filaments and liquid crystal polymer filaments selected from the group of lyotropic and thermotropic polymer filaments are known. New England Ropes of Fall River, Mass. offers a high performance double braided rope (STA-SET T-900), consisting of blended SPECTRA® filaments and TECHNORA® filaments core within a braided polyester jacket, having a diameters up to 1.5 inches (34 mm). Sampson Rope Technologies of Ferndale, Wash. offers two yacht racing ropes: VALIDATOR SK, a double braid construction having a blended, urethane coated core of VECTRAN® filaments and DYNEEMA® filaments within a braided polyester jacket in diameters up to 0.75 inches (17 mm); and LIGHTNING ROPE, a twelve-strand single braid construction having a urethane coating and made from blended DYNEEMA® filaments and VECTRAN® filaments in diameters up to 0.625 inches (16 mm). Gottifredi Maffioli S.p.A. of Novara, Italy offers high performance halyards (DZ) of a double braid construction having a composite braid made of ZYLON® filaments and DYNEEMA® filaments within a jacket in diameters up to 22 mm.

In these small diameter ropes, the reason for blending HMPE and LCP fibers is to reduce creep elongation, and not to improve high-temperature fatigue life. For example, the yachting ropes cited above are used in halyards where dimensional stability (low to no creep) is critical for consistent sail positioning. HMPE ropes are more commonly used in small sailing ropes, however for the halyard application the creep of 100% HMPE fiber is considered prohibitive. Blending HMPE with LCP fibers greatly reduces the creep elongation in the product. Reduction of creep elongation in the core of these core/jacket products also prevents the core from bunching after elongating relative to the jacket. Blending the low-creep LCP fibers with the low-cost HMPE fibers also reduces the manufacturing cost of these products.

Moreover, all of those small diameter blended rope designs would have severe limitations if scaled to larger sizes. All are constructed with braided or extruded outer jackets. Although adequate in sizes $\leqq$1.5 inches diameter, jacketed designs are less able to shed the tremendous amounts of heat that can be generated in larger ropes subjected to rapid bend cycling as over sheaves. Furthermore, jacketed designs limit the ability of the owner to assess damage done from heating or internal abrasion.

Finally, several of the prior art designs utilize parallel fiber, yarn, or strand as the core strength member. Designs that use parallel yarns or strands in the core are also subject to tensile overloads in the outer strands and compression kinking in the inner strands when subjected to bending over small radii sheaves and drums. This problem becomes more pronounced as rope size increases.

SUMMARY OF THE INVENTION

A large diameter rope having improved fatigue life on a sheave, pulley, or drum is disclosed. This rope includes a blend of HMPE filaments and liquid crystal polymer filaments selected from the group of lyotropic polymer filaments and thermotropic polymer filaments. The rope may be constructed as a braided rope, a wire-lay rope, or a parallel core rope.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DETAILED DESCRIPTION OF THE INVENTION

Figure 1:
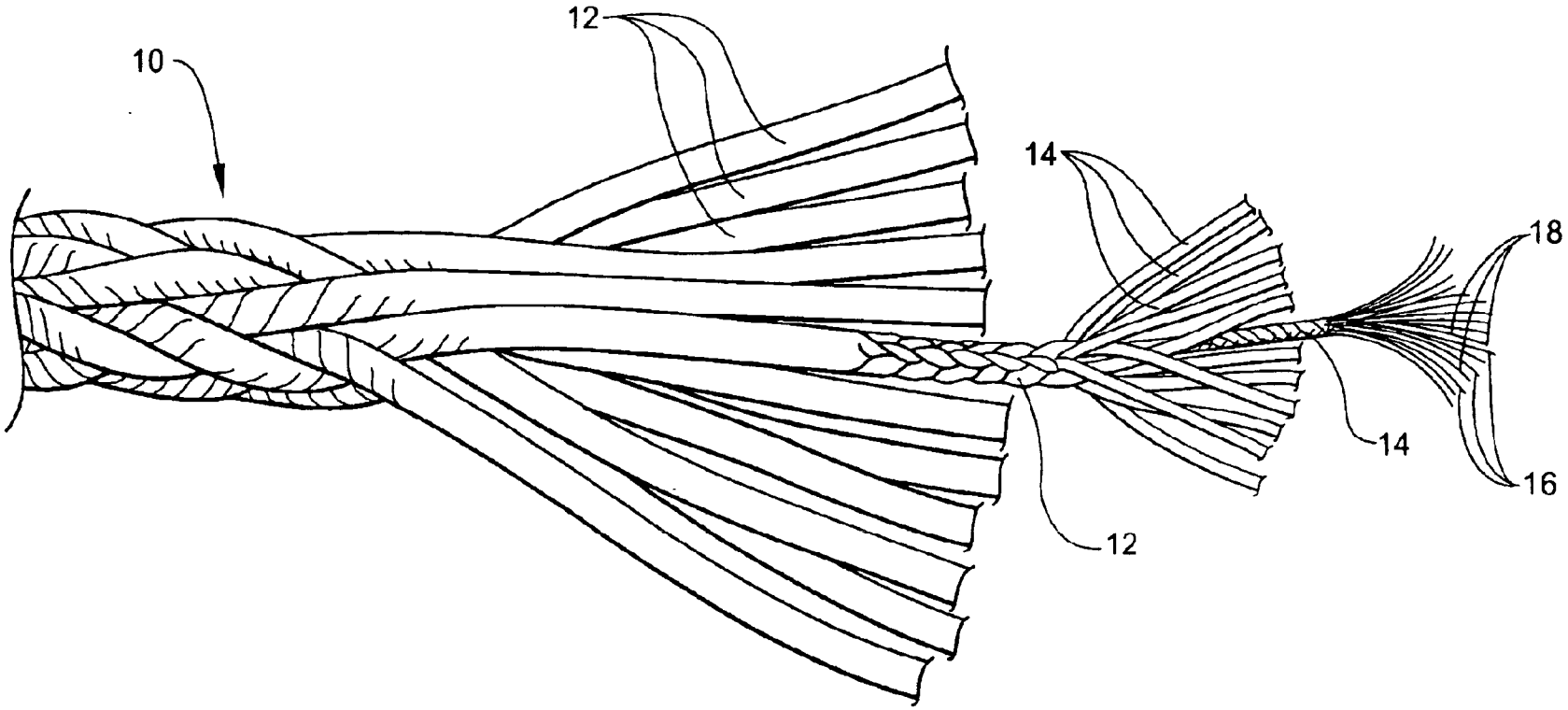
FIG. 1 is an exploded view of a preferred embodiment of a rope made according to the present invention.

Referring to the drawings wherein like numerals indicate like elements, there is shown in FIG. 1 a large diameter rope 10. The large diameter rope refers to ropes with a diameter greater than 40 mm (1.5 inches), preferably greater than or equal to 50 mm (2.0 inches), and most preferably greater than or equal to 75 mm (3.0 inches).

Rope refers to braided ropes, wire-lay ropes, and parallel strand ropes. Braided ropes are formed by braiding or plaiting the ropes together as opposed to twisting them together. Braided ropes are inherently torque-balanced because an equal number of strands are oriented to the right and to the left. Wire-lay ropes are made in a similar manner as wire ropes, where each layer of twisted strands is generally wound (laid) in the same direction about the center axis. Wire-lay ropes can be torque-balanced only when the torque generated by left-laid layers is in balance with the torque from right-laid layers. Parallel strand ropes are an assemblage of smaller sub-ropes held together by a braided or extruded jacket. The torque characteristic of parallel strand ropes is dependent upon the sum of the torque characteristics of the individual sub-ropes.

In each of these ropes, HMPE filaments and a liquid crystal polymer, high strength filament selected from the group of lyotropic and thermotropic filaments are blended together, in a known manner, to form the basic component of the rope. It is believed that in such a blend, the liquid crystal polymer fibers provide resistance against high temperatures and creep rupture, while the HMPE fibers provide lubricity to reduce the fiber-to-fiber abrasion of the LCP fibers. In multi-strand constructions, there are, preferably, no jackets on the individual strands, since they increase diameter without proportionally increasing the strength of the rope. The ratio of HMPE filaments to liquid crystal polymer filaments is in the range of 40:60 to 60:40 by volume. To facilitate the discussion of the invention, a preferred embodiment will be set out below, it being understood that the invention is not so limited.

In FIG. 1, braided rope 10 consists of a plurality of braided strands 12. Braided strands 12 are made by braiding together twisted yarns 14. Preferably, strands 12 have no jackets. Twisted yarns 14 comprise a first filament bundle 16 and a second filament bundle 18. Further information on the structure of these ropes may be found in U.S. Pat. Nos. 5,901,632 and 5,931,076, incorporated herein by reference.

The first filament bundle 16 is preferably made of HMPE filaments. HMPE filaments are high modulus polyethylene filaments that are spun from ultrahigh molecular weight polyethylene (UHMWPE) resin. Such filaments are commercially available under the tradename of SPECTRA® from Honeywell Performance Fibers of Colonial Heights, Va., and DYNEEMA® from DSM NV of Heerlen, The Netherlands, and Toyobo Company Ltd. of Osaka, Japan. The filaments may be 0.5–20 denier per filament (dpf). The bundles may consist of 100 to 5000 filaments.

The second filament bundle 18 is preferably made of high strength, liquid crystal polymer (LCP) filaments selected from the group consisting of lyotropic polymer filaments and thermotropic polymer filaments. Lyotropic polymers decompose before melting but form liquid crystals in solution under appropriate conditions (these polymers are solution spun). Lyotropic polymer filaments include, for example, aramid and PBO fibers. Aramid filaments are commercially available under the tradename KEVLAR® from Dupont of Wilmington, Del., TECHNORA® from Teijin Ltd. of Osaka, Japan, and TWARON® from Teijin Twaron BV of Arnhem, The Netherlands. PBO (polyphenylene benzobisoxazole) fibers are commercially available under the tradename ZYLON® from Toyobo Company Ltd. of Osaka, Japan. Thermotropic polymers exhibit liquid crystal formation in melt form. Thermotropic filaments are commercially available under the tradename VECTRAN® from Celanese Advanced Materials, Inc. of Charlotte, N.C. The filaments may be 0.5–20 denier per filament (dpf). The bundles may consist of 100 to 5000 filaments.

In the manufacture of the preferred rope, well-known techniques for making ropes are used. The first and second filament bundles are blended together in the volume ratios of 40:60 to 60:40 of the first filament to the second filament. These filament bundles are blended together to form the twisted yarn. The size of the bundles is not limited. The number of bundles twisted together is not limited. This blending may be accomplished by the use of an 'eye board' or 'holley board' as is well known. Then, several twisted yarns are braided together to form a braided strand. The number of twisted yarns that are braided together is not limited. It may range from 6 to 14, 8 and 12 are preferred, and 12 is most preferred. Finally, several braided strands are braided together. The number of braided strands that are braided together is not limited. It may range from 6 to 14, 8 and 12 are preferred, and 12 is most preferred. Accordingly, the most preferred rope has a 12×12 construction.

After the rope has been made, it is preferably impregnated with a water sealant/lubricant coating. This coating is preferably thermoplastic in nature and has a sufficient heat capacity, so that the coating can act as a heat sink for thermal energy generated during use of the rope. It is believed, but the invention should not be so limited, that the coating absorbs the thermal energy and becomes less viscous, exudes out of the rope, and thereby lubricates the rope. Materials suitable for the coating include coal tar, bitumen, or synthetic polymer based products. Such products include: LAGO 45 commercially available from G.O.V.I. S.A. of Drongen, Belgium; and LAGO 50 commercially available from G.O.V.I. S.A. of Drongen, Belgium. Materials unsuitable for the coating include any standard polyurethane coatings that tend to post-cure at high temperatures, e.g. between 70° to 80° C., because during post-cure many urethanes becomes brittle and friable, and the resulting powder facilitates abrasion within the rope.

Figure 2:
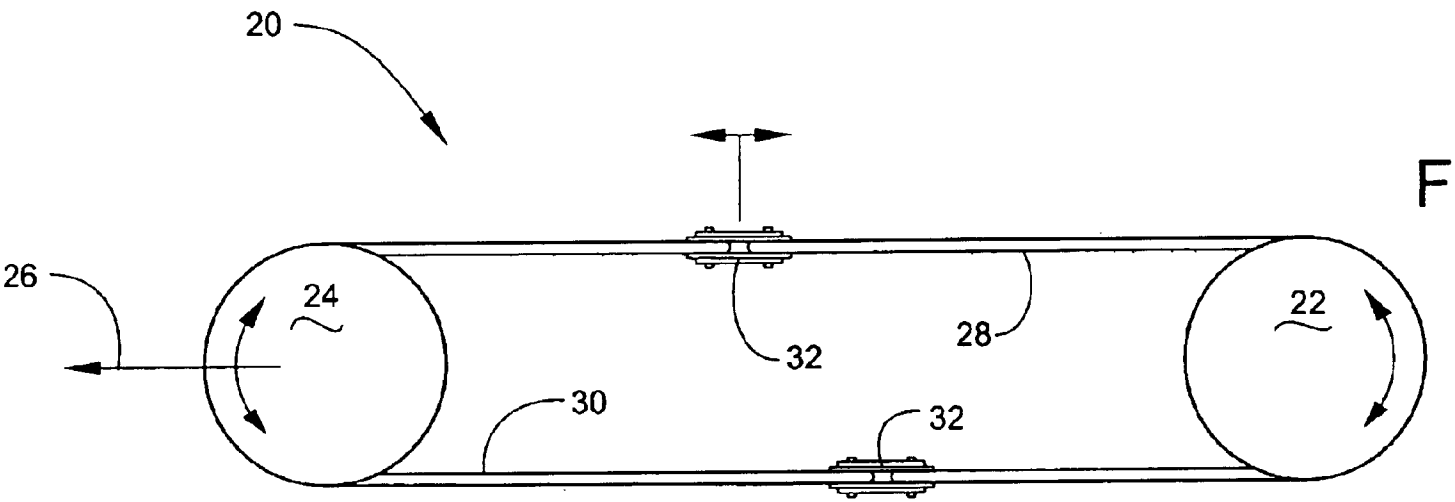
FIG. 2 is an illustration of the 'bend-over-sheave' test set up.
Figure 3:
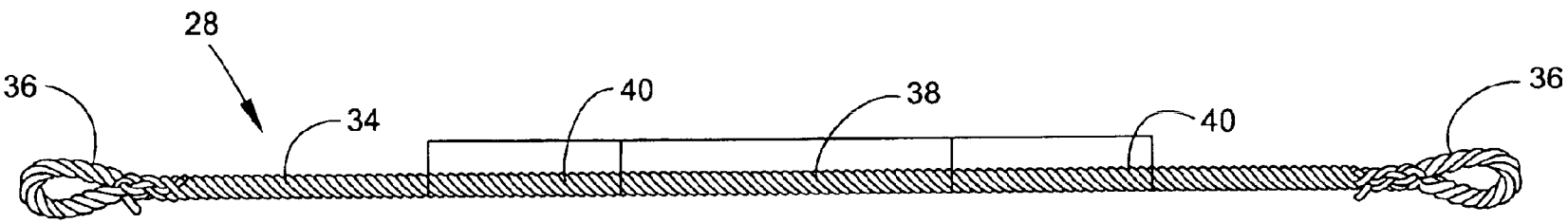
FIG. 3 is an illustration of a test specimen used in the 'bend-over-sheave' test method.

The test apparatus and test specimen used to evaluate the 'bend-over-sheave' cycle fatigue (fatigue life) are illustrated in FIGS. 2 and 3. Test apparatus 20 is shown in FIG. 2.

Apparatus 20 has a test sheave 22 and a tensioning sheave 24. Tension 26 is applied to sheave 24 as shown. First test specimen 28 and second test specimen 30 are placed on the sheaves and their free ends are joined together with a coupler 32. Test specimen 28 is illustrated in FIG. 3. Specimen 28 consists of a rope portion 34 and an eye splice 36 at each end of the rope portion. The rope portion includes a double bend zone 38 and two single bend zones 40 located on either side of zone 38. In the results set out below, the following parameter were common: the tension was 80 kips (80,000 pounds); the cycling frequency was 150 cycles per hour (CPH); the nominal stroke was 2130 mm (84 inches); the rope was a 40 mm 12×12 braided rope with the preferred coating of LAGO 45; the double bend zone was 1190 mm (3.9 feet) and the single bend zone was 945 mm (3.1 feet). In Table 1, three ropes are compared, a conventional HMPE rope, a jacketed HMPE rope, and the instant invention (50:50 blend). While the instant invention and the jacketed HMPE rope shows equivalent cycles-to-failure, the cost-per-meter, as well as, the diameter of the jacketed rope (25% greater because of jacketing on the strands) were in excess of the invention. Accordingly, the invention is preferred.

TABLE 1

| Rope | Cost-per-meter | Cycles-to-failure | Cost-per-cycle |
|---|---|---|---|
| HMPE | 115 | 8000 | 1.44 |
| Jacketed HMPE | 200 | 12000 | 1.67 |
| Invention | 164 | 12000 | 1.37 |

The present invention may be embodied in other forms without departing from the spirit and the essential attributes thereof, and, accordingly, reference should be made to the appended claims, rather than to the foregoing specification, as indicated the scope of the invention.

What is claimed is:

1. A rope for heavy lifting and mooring applications comprising: a rope construction selected from the group consisting of braided ropes, wire-lay ropes, or parallel core ropes, said constructions having a diameter greater than 38 mm and being made of a blend of HMPE filaments and second high strength filaments being selected from the group of lyotropic polymer filaments and thermotropic polymer filaments.

2. The rope of claim 1 further comprising a coating for lubricating said rope.

3. The rope of claim 2 wherein said coating being a bitumen based product.

4. The rope of claim 1 wherein the blend comprises 40:60 to 60:40 of HMPE filaments to second high strength filaments.

5. The rope of claim 1 wherein said diameters being greater than 51 mm.

6. A large diameter, braided rope comprising:

a plurality of first filaments and a plurality of second filaments, said first filaments being HMPE filaments and second filaments being selected from the group consisting of lyotropic polymer filaments and thermotropic polymer filaments, said HMPE filaments and said second filaments being twisted together to form a twisted yarn, a plurality of twisted yarns being braided together to form a braided strand, and a plurality of braided strands being braided together to form said large-diameter braided rope.

7. The rope of claim 6 having a diameter greater than or equal to 50 mm.

8. The rope of claim 6 having no jacket on said strands.

9. The rope of claim 6 wherein said plurality of twisted yarns comprises 6–14 twisted yarns.

10. The rope of claim 9 wherein said plurality of twisted yarns comprises 8–12 twisted yarns.

11. The rope of claim 6 wherein said plurality of braided strands comprises 6–14 strands.

12. The rope of claim 11 wherein said plurality of braided strands comprises 8–12 strands.

13. The rope of claim 6 further comprising a coating for lubricating said rope.

14. The rope of claim 13 wherein said coating being a bitumen based product.

15. A method of improving fatigue life of a rope on a sheave, pulley, or drum comprising the steps of:

providing a rope having 40–60 percent by volume of HMPE filaments, and 40–60 percent by volume of a liquid crystal polymer filament selected from the group consisting of lyotropic polymer filaments and thermotropic polymer filaments.

16. The method according to claim 15 wherein said rope being a large diameter rope wherein said HMPE filaments and said other filaments being twisted together to form a twisted yarn, a plurality of twisted yarns being braided together to form a braided strand, and a plurality of braided strands being braided together to form said large diameter braided rope.

17. The method according to claim 16 wherein said rope having a diameter greater than or equal to 40 mm.

18. The method according to claim 16 wherein said rope being a 12×12 braided rope.

19. The method according to claim 16 wherein said rope having a coating for lubricating said rope.

* * * * *